United States Patent [19]

Cohen et al.

[11] Patent Number: 4,855,698

[45] Date of Patent: Aug. 8, 1989

[54] PROTECTIVE SWITCHING APPARATUS WITH REMOTELY CONTROLLED OPENING AND CLOSING OF THE CONTACTS

[75] Inventors: Jacques Cohen, Couchey; Pierre Lemarquand, Velars/Ouche; Christian Pichard, Asnieres-les-Dijon, all of France

[73] Assignee: La Telemecanique Electrique, France

[21] Appl. No.: 154,264

[22] Filed: Feb. 10, 1988

[30] Foreign Application Priority Data

Feb. 13, 1987 [FR] France ..... 87 01818

[51] Int. Cl.[4] ..... H01H 75/00

[52] U.S. Cl. ..... 335/14; 335/20

[58] Field of Search ..... 335/6, 16, 14, 20

[56] References Cited

U.S. PATENT DOCUMENTS 4,164,719 8/1979 Young et al. ..... 335/14

4,725,794 2/1988 Bratkowski et al. ..... 335/14

*Primary Examiner*—E. A. Goldberg

*Assistant Examiner*—Lincoln Donovan

*Attorney, Agent, or Firm*—William A. Drucker

[57] ABSTRACT

A protective switching apparatus with remote controlled opening and closing is provided including a tripping mechanism connected to an assembly comprising at least two fixed contacts and two mobile contacts and to a magnetic and/or thermal trip; a resetting member and an electromagnet having a movable element and to a member for driving a least one pseudo-fixed or mobile contact. The mobile contacts are carried by a bridge having a plane of symmetry X—X and the tripping mechanism extends in the vicinity of the plane of symmetry X—X. The electromagnet and the trip are housed in the case on each side of the tripping mechanism in a direction perpendicular to the plane of symmetry.

9 Claims, 6 Drawing Sheets

PROTECTIVE SWITCHING APPARATUS WITH REMOTELY CONTROLLED OPENING AND CLOSING OF THE CONTACTS

BACKGROUND OF THE INVENTION

1. Field of the Invention

The present invention relates to an electromechanical protective switching apparatus with remote controlled opening and closing of the contacts.

2. Description of the Prior Art

Such protective switching apparatus are well known. In particular, from patent No. FR-2 573 571, it is known to combine in the same circuit breaking apparatus a protective function in the case of an overcurrent (circuit breaking mode) and a remote opening control function (contactor mode); these protective and control functions are provided respectivey by a free tripping mechanism and by a specific control electromagnet, acting independently on the same set of separable contacts of the apparatus.

Such a device cannot however be readily adapted to a multipole protective switching apparatus with contact bridges because of the volume occupied by the bridges and the contact holding piece which houses the bridges, which volume is added to the volume occupied by the tripping mechanism and the electromagnet.

The same goes for the circuit breaker described in patent U.S. Pat. No. 4,604,596. In this circuit breaker, the plate or the core of a biased electromagnet is connected to an arm carrying a pseudo-fixed contact. This contact may thus be withdrawn by the electromagnet acting in contactor mode without interaction with the abrupt tripping mechanism. The arrangement of such a circuit breaker is however specific to an apparatus with small transverse dimension.

The object of the present invention is in particular to provide a protective switching apparatus with remote controlled opening and closing of at least one contact bridge using a simple arrangement with minimized dimension, particularly in a direction kept parallel to the contact bridge or bridges.

Its object is to separate, in a very simple manner, the circuit breaker part and the contactor part of the protective switching apparatus having at least one contact bridge.

SUMMARY OF THE INVENTION

The protective switching apparatus of the invention comprises in a case, particularly a multipole case, at least one switchable current path, a manual tripping or overcurrent device having a tripping mechanism connected both to the set of contacts and to a magnetic and/or thermal trip, this latter controlling said mechanism so as to open the set of contacts, a resetting member for closing the set of contacts again and a remote electric control device, having an electromagnet with an element movable in response to an electric opening or closing order and a drive member secured to the movable element and capable of driving at least one pseudo-fixed contact or mobile contact of the set of contacts.

In the invention, the set of contacts comprises at least two fixed contacts each connected to a respective connection terminal and at least two mobile contacts each associated with one of the fixed contacts and carried by a respective contact bridge with plane of symmetry X—X movable in a direction contained in this plane of symmetry. The tripping mechanism extends in the vicinity of the plane of symmetry X—X and the electromagnet of the electric control device and the magnetic and/or thermal trip are housed respectively in the case on each side of the tripping mechanism in a direction Y—Y perpendicular to the plane of symmetry.

The protective switching apparatus thus adapted is particularly simple and compact.

The electric control electromagnet may have an axis of symmetry X1—X1 parallel or perpendicular to the plane of symmetry X—X. Preferably, the tripping mechanism is housed in a compartment which is narrow in the direction Y—Y perpendicular to the plane of symmetry and from which there project from the case an on button and an off button movable parallel to the plane X—X, and the electric control electromagnet housed laterally in the compartment has an axis of symmetry X1—X1 parallel to the plane X—X and has its smallest dimension in the direction Y—Y perpendicular to the plane of symmetry.

Thus, a part of the tripping compartment, as well as the magnetic and thermal trips and the remote control electromagnet can be advantageously housed in a nose of the case having the usual standardized width of 45 mm for low voltage electric appliances.

In a first embodiment, advantageous because of its simplicity, the electric control electromagnet causes a single break; the contact of the bridge movable by the drive member in the contactor mode is one of the fixed contacts—or pseudo-fixed contact, whose retraction by the electromagnet results in the desired opening of the contacts and limited rocking of the contact bridge. Such limitation of the rocking of the contact bridge may be provided by a stop which is fixed with respect to the case or, very simply, by the contact holder itself.

In a second embodiment, simple and advantageous for the remote controlled opening of the contacts does not modify the break chamber, the electric control electromagnet again causes a single break; the contact of the bridge movable by means of the drive member in contactor mode is one of the mobile contacts of the bridge; pushing of the contact bridge by the drive member at a point offset with respect to the plane X—X then causes the desired break, whereas the contact bridge undergoes limited rocking movement. Preferably, the electric control electromagnet comprises an armature or mobile core with axis X1—X1 parallel or perpendicular to the plane X—X, secured directly or through a lever to a comb shaped slide whose teeth each pass into a narrow space formed between the contact holder and a fixed contact piece.

In a third embodiment, the remote control electromagnet causes a double break; the drive member is formed by a lever which can be applied against the contact holder for driving it, whereas the contact holder includes a resiliently extendable link so as to make driving of the contact holder possible in the contactor mode while ensuring the desired independence of the movements of the lock of the circuit breaker and of the lever.

BRIEF DESCRIPTION OF THE DRAWINGS

Other features and advantages of the present invention will be clear from the following description, with reference to the accompanying drawings in which.

DESCRIPTION OF THE PREFERRED EMBODIMENTS

Figure 1:
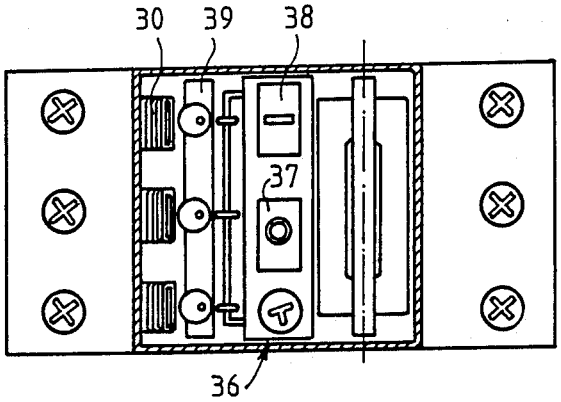
FIG. 1 is a top view in partial section through plane I—I of FIG. 2 of a first embodiment of a protective switching apparatus of the invention with a single break in the contactor mode.
Figure 2:
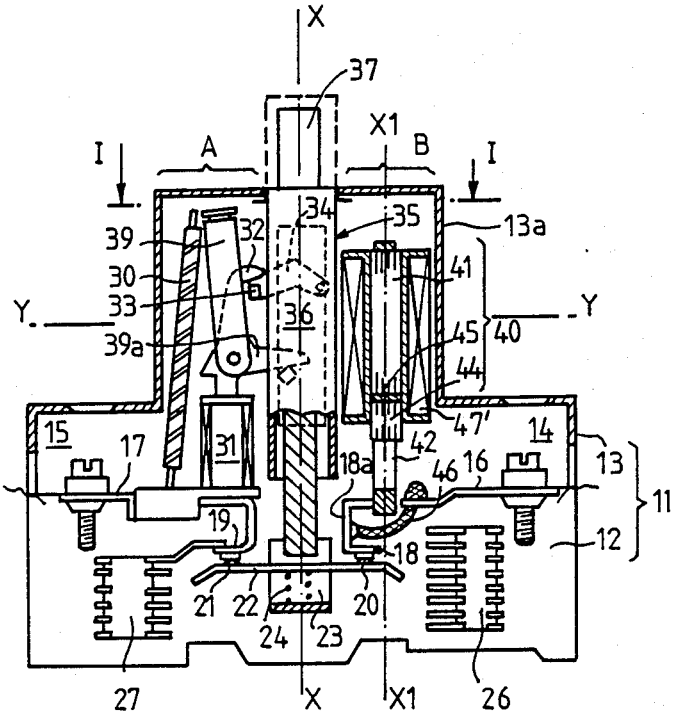
FIGS. 2 and 3 show in elevation a schematical section of the apparatus of FIG. 1, respectively in the closed state and in the remote controlled open state of the contacts.
Figure 3:
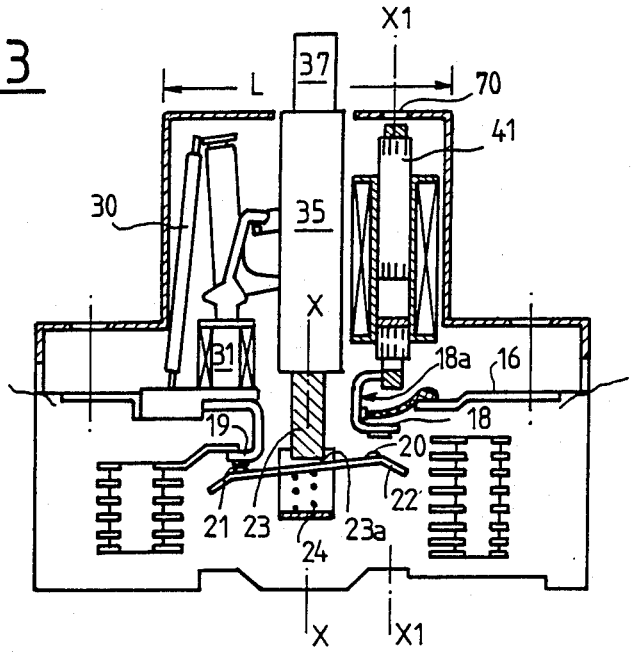

The protective switching apparatus 10 illustrated in FIGS. 1 to 3, is a multipole appliance—in this example a three pole—but which may be also two or four pole. The apparatus is with double break either for manually tripping or tripping on a fault (circuit breaker mode) and it has a single break in the case of remote control opening (contactor mode). It has a molded case 11 with a base 12 and a lid 13 having a nose 13*a* with a standarized width L of 45 mm which is usual for low voltage electric appliances. Each pole includes a switchable current path between two terminals 14, 15 adapted for connecting external conductors not shown. To the terminals 14, 15 are connected respective flat connecting pieces 16, 17 which are each connected electrically to a fixed contact 18, 19 disposed on a respective fixed contact piece which ends in the shape of a C. The current path between the two contacts 18, 19 is made or broken by means of a mobile contact bridge 22 with a plane of symmetry X—X carrying two mobile contacts 20, 21, cooperating with the fixed contacts 18, respectively 19.

The mobile bridges 22 of the different poles are housed in a contact holding piece 23 and are each urged by a respective contact pressure spring 24; the contact holder is movable in a direction contained in the plane X—X.

In the breaking zone, a block of arc breaking fins 26, 27 is provided on each side of the bridge. Each connection piece 17 is connected to a thermal bimetallic strip trip 30 disposed in series with a magnetic trip 31. The mobile element 32 of trip 31 may actuate a rocking lever 33 common to the different poles and fixed to a pivoting lever 34 which penetrates into a compartment 35 housing a tripping lock mechanism 36 so as to actuate this latter; in compartment 35 are mounted a tripping push button or off button 37 and a reset push button or on button 38. Each bimetallic strip 30 is able to actuate a common rocking lever 39 with an arm 39*a* which penetrates into compartment 35 for acting on lock 36. Two housings A, B substantially of the same volume are formed beween the compartment 35 and the modular nose 13*a* of case 11. It should be noted that compartment 35 is narrow in the direction Y—Y perpendicular to the plane X—X.

In housing A are disposed the thermal 30 and magnetic 31 trips and the corresponding rocking levers 33, 39. In housing B there is disposed, in accordance with the invention, an electric control electromagnet 40 having an axis of symmetry X1—X1 parallel to X—X. The electromagnet 40 has a flat shape parallel to plane X—X (FIG. 1) and it is provided with a coil 47 and a mobile magnetic circuit armature, in ths case a flat mobile core 41.

Figure 4:
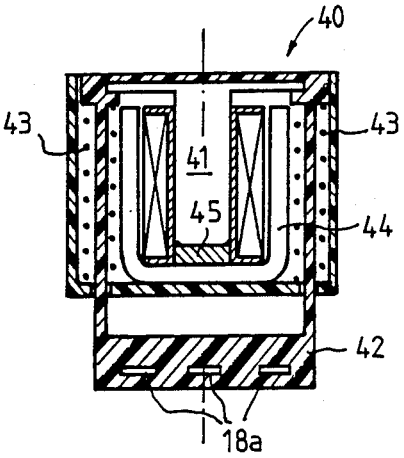
FIG. 4 shows an elevational view of one embodiment of a remote control electromagnet adapted to the apparatus of FIGS. 1 to 3.

The core is fixed to a mobile assembly or insulating slide 42 urged by at least one spring 43 to a contact opening position (see FIG. 4). The armature could also be connected to the slide via a pivoting lever.

In the version shown in FIG. 4, the electromagnet 40, shown in the position for remote controlled closure of the contacts, is of the bistable type and includes a fixed U shaped magnetic circuit 44 to the web of which is fixed a permanent magnet insert 45. This latter may engage the mobile core 41—in the low position shown in FIG. 4—and immobilize the slide 42 against the forces of the springs 43 in the shown contact closure position. Slide 42 is, for this purpose, connected directly to pseudo-fixed contact pieces 18a which form wholly or partially the fixed contact pieces of the different poles. Flexible electrical connection 46 such as a braid is provided between the connection piece 16 and the pseudo-fixed contact piece 18*a*.

To go over to the remote controlled open position shown in FIG. 3, the mobile core 41 rises after being separated from magnet 45 after receiving a current pulse producing an antagonistic flux with respect to that of the magnet; in this way, the slide 42 rises with the pseudo-fixed contact 18*a* which becomes separated from the mobile contact 20. This latter rises in fact slightly until the contact bridges 22 abut against the contact holder 23.

In a bistable variant not shown, the electromagnet 40 comprises two opposite engagement magnets and it is then without springs 43.

Figure 5:
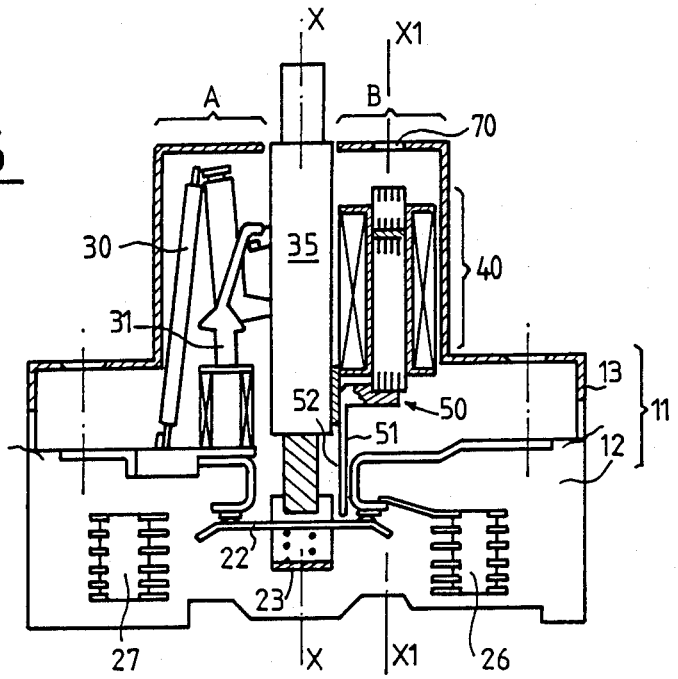
FIGS. 5 and 6 are views similar to FIGS. 2 and 3 of a second embodiment of a single break apparatus in the contactor mode.
Figure 6:
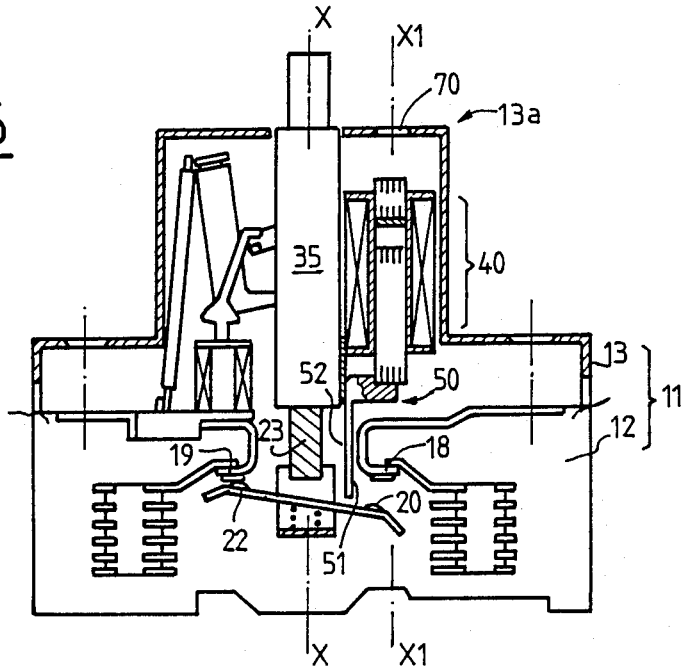

In the embodiment shown in FIGS. 5 and 6, the switching apparatus provides a single break for remote control and has an electromagnet advantageously bistable with a permanent magnet and with "top" engagement which will be described in connection with FIG. 9. Slide 42 is fixed or secured to a bent driving comb 50 having insulating pushers 51 parallel to the plane X1—X1 and situated between this latter and the plane X—X; each pusher 51 is associated with a respective contact bridge and passes through a narrow space 52 formed between the contact holder 23 and the respective fixed contact 18; another pusher 51 may be used for controlling an additional switch.

It can be seen that the remote controlled opening of the contacts is caused by the movement of core 41 and takes place with rocking of the contact bridge 22 about the fixed contact bridge 19 situated opposite the electromagnet 40 with respect to the plane X—X. Rocking of the bridge is accompanied by crushing of the contact pressure spring 24. Springs 43 exert a force greater than the contact pressure, so that opening of the contacts corresponds to any release of the electromagnet.

Figure 9:
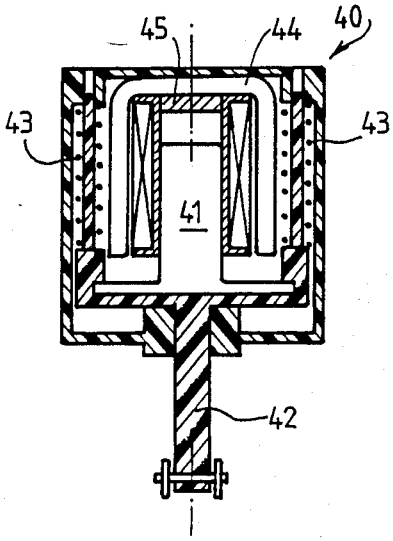
FIG. 9 shows in elevation another embodiment of the remote control electromagnet adapted to the apparatus of FIGS. 5 to 8.
Figure 7:
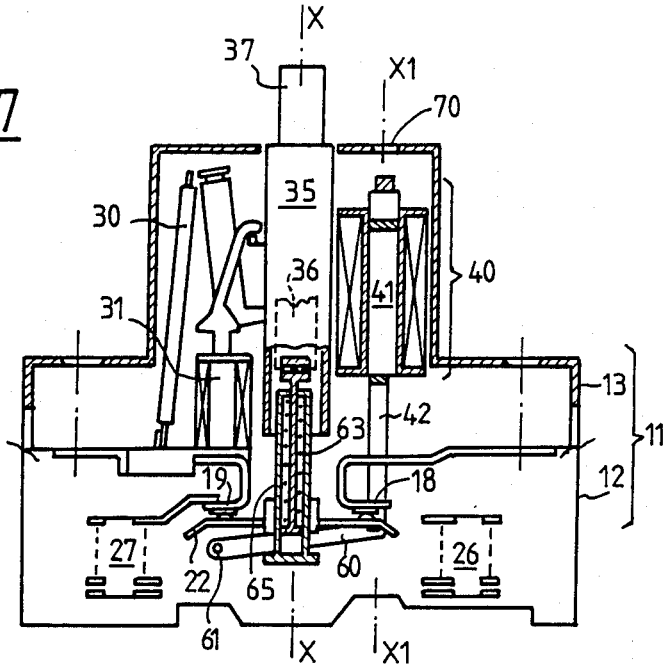
FIGS. 7 and 8 are views similar to FIGS. 2 and 3 of a third embodiment of a double break apparatus in the contactor mode.
Figure 8:
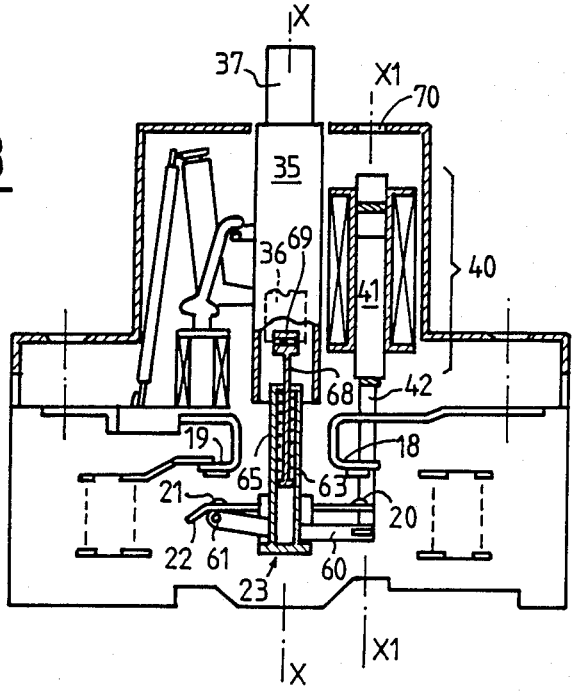

In the embodiment shown in FIGS. 7 and 8, the circuit breaking apparatus is with double break for remote control and has a flat electromagnet for example of the type illustrated in FIG. 9. The slide 42 of the electromagnet is hinged at its lower end to a lever 60 mounted for pivoting about a pin 61 fixed with respect to the case. Lever 60 is applied at an intermediate point of its length to a bearing surface 62 of the contact holder 23 The contact holder has the characteristic of including a resilient extendable link so as to ensure the independence of the movements of the lock of the circuit breaker and of lever 60. The resilient link in the present embodiment comprises two mutually movable parts of the contact holder and an intermediate compression spring 63. Spring 63 is housed in a guide 64 of the lower part 65 of the contact holder between a support 66 of this lower part and a support 67 of the upper part 68 of the contact holder. This upper part is a link surrounded by spring 63 and guided by the lower part 65 and it has a head 69 for connection with the lock of the circuit breaking apparatus. With such a construction of the contact holder, the desired separation can be obtained while remaining compact.

The flat electromagnet shown in FIG. 9 is adapted to the two embodiments shown in FIGS. 5, 6, and 7, 8. It is shown in the contact open state and differs slightly from the electromagnet of FIG. 4 in that the core is engaged in the top position in the on state of the apparatus and is driven to the low position in the off state of the apparatus. The permanent engagement magnet 45 is therefore situated in the top part of the electromagnet against the web of the up turned U of the fixed magnetic circuit, whereas springs 43 tend to push the mobile assembly 42 back downwards.

Figure 13:
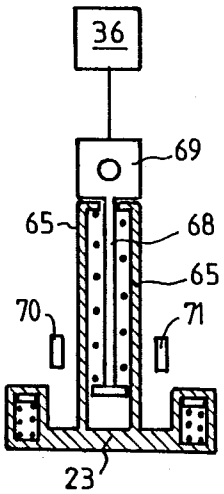
FIGS. 10 to 13 show schematically in section different positions of a contact bridge belonging to a two pole apparatus of the type illustrated in FIGS. 7 and 8.

FIGS. 10 to 13 show, in a two pole circuit breaker shown in FIGS. 7 and 8, the contact holder 23 and lever 60 in the following respective states: open contacts with circuit breaker closed and contactor open (FIG. 10); closed contacts with circuit breaker closed and contactor closed (FIG. 11); contacts open with circuit breaker open and contactor open (FIG. 12); contacts open with circuit breaker open and contactor closed (FIG. 13).

It should be noted that lever 60 has two parallel arms 70, 71 applicable to the bearing surfaces 62 of the lower part 65 of the contact holder on each side of the guide 64 of spring 63. Contact holders may of course be designed with different resilient links, for example with a central lever and two lateral springs; the compression spring 63 may be replaced by a traction spring.

Figure 11:
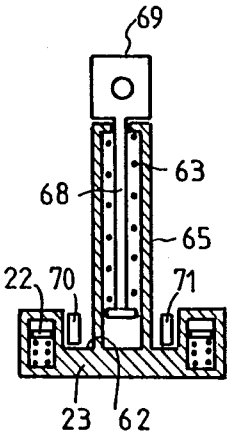
Figure 10:
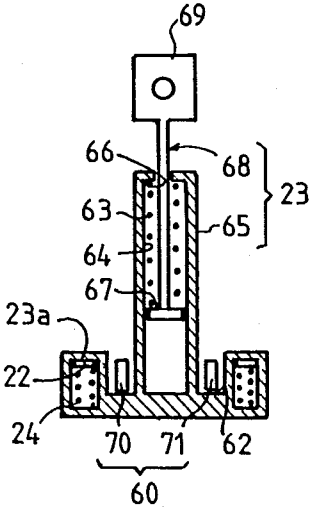

The circuit breaking apparatus shown in FIGS. 7 and 8 operates in the following way:

It is assumed that the apparatus is initially in the on state shown in FIG. 11. To go over to the remote controlled off state shown in FIG. 10, lever 60 pivots in a clockwise direction in response to the downward movement of the mobile assembly 42 (FIG. 8). Thus lever 60 bears on the bearing surfaces 62 of the contact holder 23. The contact bridges 22 are applied against the stops 23*a* of the lower part 65 of the contact holder under the effect of springs 24, so that the mobile contacts may be separated from the fixed contacts and the spring 63 of the resilient link is compressed between the support 67 held stationary with the upper part of the contact holder and support 66 of the lower part of the contact holder lowered by lever 60.

When the magnetic trip 31 or the thermal trip 30 detects an excessive overcurrent, or when the off button 37 is actuated, the lock 36 of the circuit breaking apparatus is actuated and causes head 69 of the upper part 68 of the contact holder to move down. This latter passes then from the state shown in FIG. 11 to the open state shown in FIG. 13. The contact holder moves down without undergoing any resilient extension, which is contrary to the preceding case. The fixed and mobile contacts are separated whereas the lower part 65 of the contact holder is freed from lever 60 (FIG. 13). It should be observed that in the case of manual actuation of button 37, opening of the contacts takes place in a reliable fashion by part 68 coming to bear directly against part 65 of the contact holder.

Figure 12:
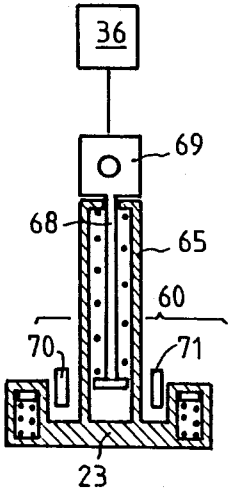

FIG. 12 shows the case where a remote opening order is added to a manual or overcurrent trip. With the contact holder brought to the same position as in FIG. 13, lever 60 moves down without being applied thereagainst for the stroke of the contact holder in the circuit breaker mode is slightly greater than its stroke in the contactor mode.

In the embodiments shown in FIGS. 5, 6, 7, 8, a member may be provided for forcing the core 41 of the electromagnet. This member is formed for example by a part of slide 42 accessible through a recess 70 in the front face of the apparatus. It makes it possible to force the opening of the contact bridges 22. A similar device may be provided in the embodiment shown in FIGS. 1 to 3 on condition that an appropriate change of direction of lever is provided for transforming a downward movement exerted by recess 70 into a rising movement of the slide. The accessible slide part may also serve as state display element visible through recess 70.

A device for the pulsed electric control of the bistable electromagnet described above may be integrated in case 11 and adapted so as to transmit to the coil of the electromagnet bidirectional control pulses. In a variant, the electromagnet may be monostable so as to maintain the contacts closed—or open—when its coil is supplied with power.

Figure 14:
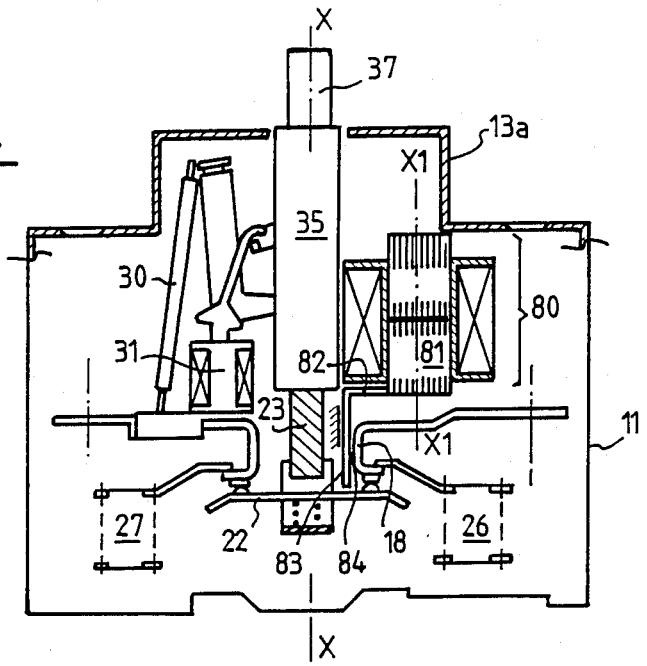
FIGS. 14 and 15 show two other variants of the apparatus of the invention.
Figure 15:
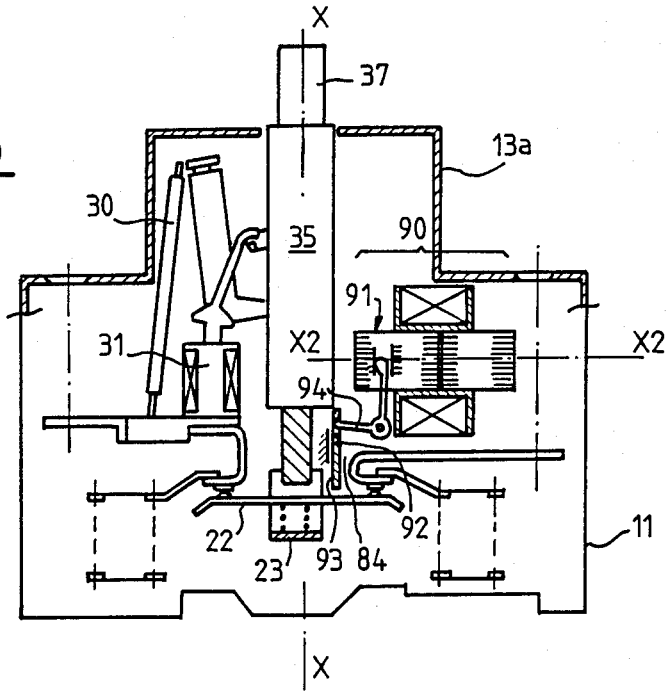

Two embodiments of the apparatus using monostable electromagnets are thus shown in FIGS. 14 and 15. As is known, a monostable electromagnet requires a larger magnetic circuit and coil than a bistable electromagnet because of the holding current. In FIG. 14, the electromagnet 80 is not housed in the nose of the apparatus, but has a mobile core 81 with axis X1—X1 parallel to the plane X—X and secured to a comb shaped slide 82 whose teeth 83 pass parallel to plane X—X into a narrow space 84 between the contact holder 23 and the contact piece 18.

In FIG. 15, the electromagnet 90 is not housed in the nose of the apparatus and has a mobile core 91 with axis X2—X2 perpendicular to the plane X—X and actuating, via a change of direction lever 94, a comb shaped slide 92 whose teeth 93 pass parallel to plane X—X into the narrow space 84.

The thrust slides or teeth are of course suitably guided in their movement parallel to plane X—X.

It will be noted that slides 42, 82, 92 especially when they are formed in a single piece with the rocking fingers of the contact bridges, are advantageously formed by thin pieces, for example strips or blades whose small thickness allows the teeth to pass through spaces 52 without any adverse effect on the size of the apparatus.

What is claimed is.

1. A circuit breaker with remote control, said circuit breaker comprising :

i. a housing having a median plane which defines first and second volume portions within said housing ;

ii. a movable contact support bridge extending at right angles to said plane from a first end portion which supports a first movable contact and is housing in said first volume portion to a second end portion which supports a second movable contact and is housed in said second volume portion, said bridge being mounted for translation in a direction parallel to said plane and for pivoting at said first end portion about an axis parallel to said plane and at right angles to said direction;

iii. stop means for angularly limiting the pivoting of said bridge ;

iv. first and second further contacts respectively cooperating with said first and second movable contacts, at least said first further contact being fixed with respect to the housing ;

v. biasing means cooperating with said bridge and normally maintaining said movable contacts in engagement with said further contacts ;

vi. an elongate trip mechanism extending along said median plane and having an operating condition in which it cooperates with said bridge to disengage the movable contacts from the respective further contacts ;

vii. means, including current fault responsive trip means, coupled to said trip mechanism, for switching the trip mechanism into the operating condition, said current fault responsive trip means being housing in said first volume portion ;

viii. remotely controlled electromagnet means housing in said second volume portion and means having an actuating member which cooperates with at least one of said second further contact and said second movable contact for separating said second further contact and said second movable contact from each other.

2. A circuit breaker with remote control, said circuit breaker comprising :

i. a housing having a median plane which defines first and second volume portions within said housing;

ii. a movable contact support bridge extending at right angles to said plane from a first end portion which supports a first movable contact and is housed in said first volume portion to a second end portion which supports a second movable contact and is housed in said second volume portion, said bridge being mounted for translation in a direction parallel to said plane;

iii. first and second further contacts respectively cooperating with said first and second movable contacts, said first and second further contacts being fixed with respect to the housing;

iv. biasing means cooperating with said bridge and normally maintaining said movable contacts in engagement with said further contacts;

v. an elongate trip mechanism extending along said median plane and having an operating condition in which it cooperates with said bridge to disengage the movable contacts from the respective further contacts;

vi. means, including current fault responsive trip means, coupled to said trip mechanism for switching the trip mechanism into the operating condition, said current fault responsive trip means being housed in said first volume portion ;

vii. remotely controlled electromagnet means housed in said second volume portion and having an actuating member;

viii. coupling means coupling said elongate trip mechanism to said movable contact bridge for disengaging the movable contacts from the respective fixed contacts in the operating condition of said trip mechanism, said coupling means having a first member which is coupled to the contact bridge and a second member which is rigidly coupled to the trip mechanism, and spring means resiliently connecting the first and second members when the trip mechanism is in the operating condition; and ix. a lever pivoting at said first end portion about an axis parallel to said plane and at right angles to said direction, said lever being hinged to the actuating member of the removably controlled electromagnet means and engaging said first member to separate the movable contacts from the fixed contacts.

3. A circuit breaker as claimed in claim 1, wherein said median plane is a plane of symmetry of said housing, said movable contact support bridge and said trip mechanism, and said actuating member effects a translation parallel to said direction.

4. A circuit breaker as claimed in claim 1, wherein said actuating member comprises an insulating slider which cooperates with the movable contact support bridge, whereas the second further contact is fixed with respect to the housing.

5. A circuit breaker as claimed in claim 1, wherein the second further contact is movable and said actuating member is coupled to said second further contact.

6. A circuit breaker as claimed in claim 2, wherein said housing includes parallelepipedic base and cover portions, said movable contact support member and said further contacts being housed in said base portion and said cover portion having a dimension at right angles to said plane of symmetry which is substantially smaller than the dimension of said base portion at right angles so said plane of symmetry.

7. A circuit breaker as claimed in claim 1, wherein said remotely controlled electromagnet means comprise an electromagnet of the bistable type which includes a coil, a fixed magnetic circuit having a permanent magnet and a mobile core made of a ferromagnetic material urged by at least one spring towards a position distant from the permanent magnet, said remotely controlled electromagnet means further comprising electric control circuit means transmitting bidirectional control pulses to said coil.

8. A circuit breaker as claimed in claim 1, wherein said remotely controlled electromagnet means comprise an electromagnet of the bistable type, which includes a coil , a fixed magnetic circuit with two permanent magnets and a mobile core made from a ferromagnetic material, said remotely controlled electromagnet means further comprising electric control circuit means transmitting bidirectional control pulses to said coil.

9. A circuit breaker as claimed in claim 1, wherein said remotely controlled electromagnet means comprise an electromagnet of the monostable type.

* * * * *